United States Patent [19]

Boyesen

[11] Patent Number: 4,858,991

[45] Date of Patent: Aug. 22, 1989

[54] CHAIR FOR INFANTS

[76] Inventor: Eyvind Boyesen, R.D. #2, P.O. Box 246-A, Kempton, Pa. 19529

[21] Appl. No.: 129,373

[22] Filed: Nov. 23, 1987

Related U.S. Application Data

[63] Continuation of Ser. No. 895,165, Aug. 11, 1986, abandoned, which is a continuation-in-part of Ser. No. 761,563, Aug. 1, 1985, abandoned, which is a continuation-in-part of Ser. No. 487,077, Apr. 21, 1983, abandoned.

[51] Int. Cl.[4] ..... A47C 3/23

[52] U.S. Cl. ..... 297/195; 297/392; 297/464; 297/467; 297/487

[58] Field of Search ..... 297/195, 274, 292, 307, 297/349, 392, 464, 467, 487; 248/458; 108/131, 142

[56] References Cited

U.S. PATENT DOCUMENTS

| | | | |
|---|---|---|---|
| 326,184 | 9/1885 | White | 297/464 X |
| 527,056 | 10/1884 | Gilson | 297/464 |
| 3,754,787 | 8/1973 | Garber | 297/195 X |

*Primary Examiner*—Peter R. Brown

*Attorney, Agent, or Firm*—Kenneth P. Synnestvedt

[57] ABSTRACT

A chair, particularly adapted for use by infants, is disclosed, including a chair body having a generally upright part with a forwardly inclined supporting surface and an interconnected rearwardly extending lower part adapted to form a seat for the infant when the infant is positioned on the chair with the front of the torso presented toward the upright end forwardly inclined chair body, the chair further including adjustable infant supporting means mounted on the chair body and having upper and lower portions presented at an upwardly and rearwardly inclined angle, thereby providing for gravitational support of upper and lower portions of an infant occupant in a forwardly inclined position.

5 Claims, 5 Drawing Sheets

Fig. 9.
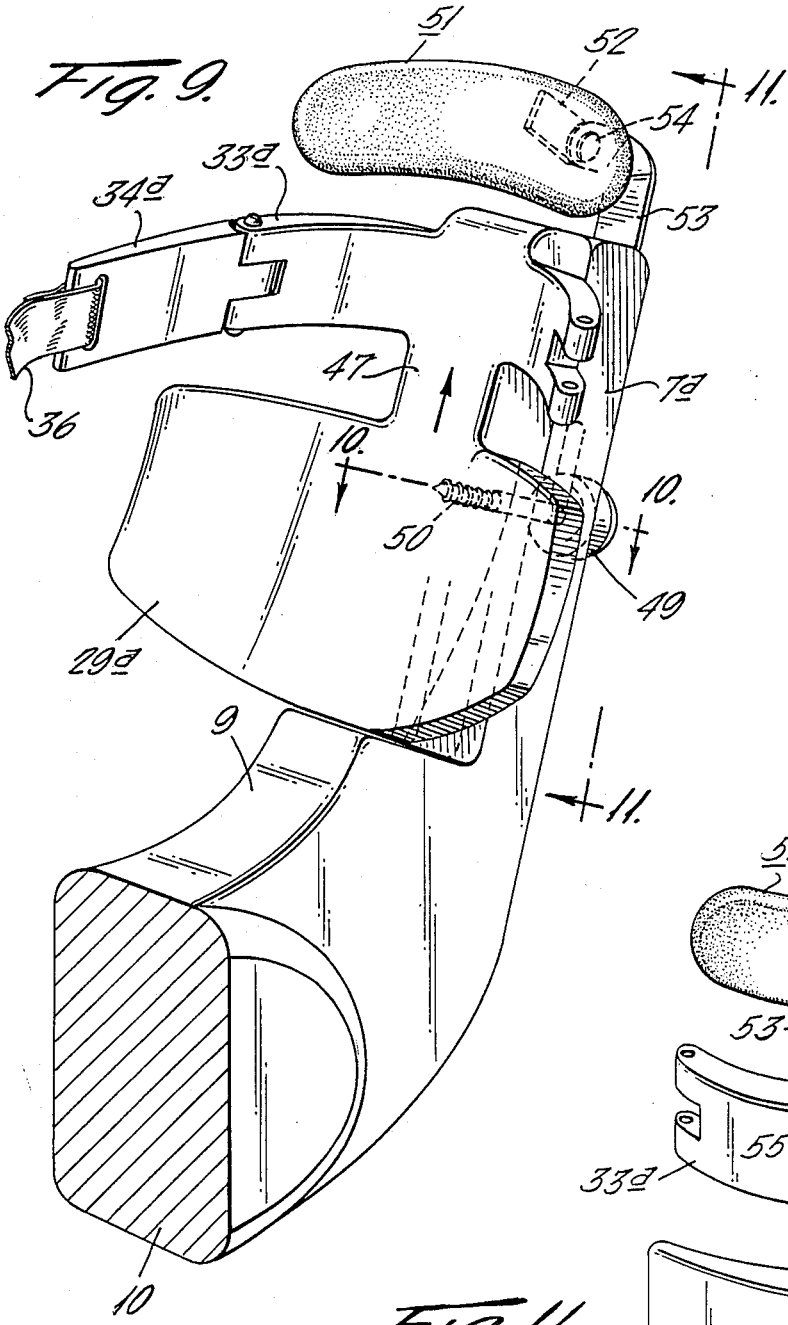
Fig. 10.
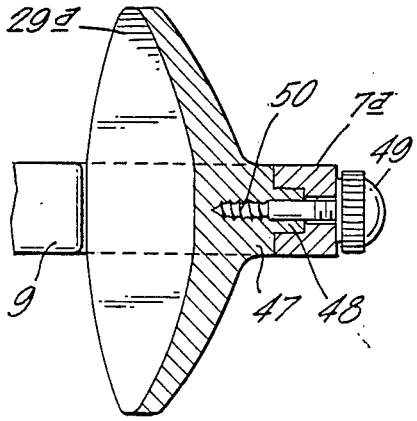
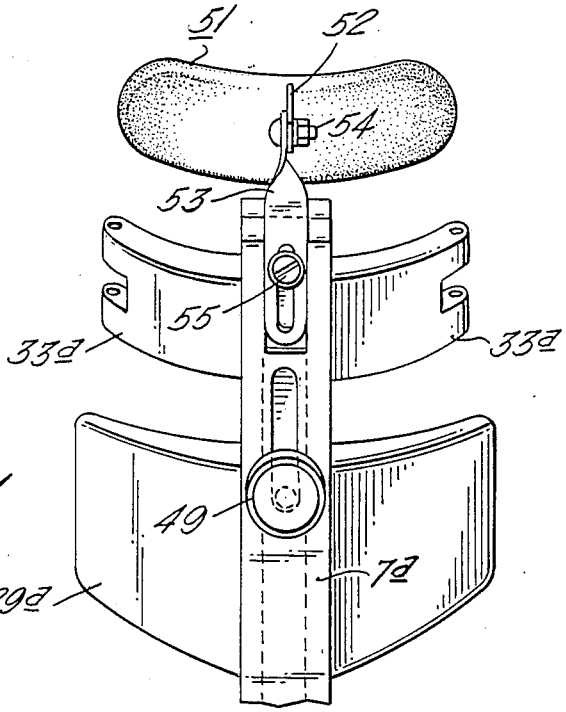
Fig. 11.

CHAIR FOR INFANTS

CROSS REFERENCES

This is a continuation-in-part of my application Ser. No. 761,563, filed Aug. 1, 1985, now abandoned, which, in turn, is a continuation-in-part of my application Ser. No. 487,077, filed Apr. 21, 1983, now abandoned.

BACKGROUND AND STATEMENT OF OBJECTS

This invention relates to a chair, especially configured for use by infants, for instance, infants between the ages of from about 1 month to about 18 months.

In accordance with conventional infants' chairs or supports, the primary structure of the chair or support is frequently arranged so that the infant is placed with its back lying against the supporting structure. Experience has shown that this is frequently distressing to the infant for one reason or another, including the pressures on portions of the back and spine which are incident to laying the infant upon its back on a horizontal or even an inclined surface.

In addition, after feedings, when infants commonly require release of gases from the stomach (burping), the positioning of an infant with its back resting upon a generally horizontal or even an inclined surface is not well adapted to the release of the stomach gases. For these reasons, for the comfort of the infants and for release of stomach gases, infants have quite commonly been positioned on the supporting surface in position with the stomach underneath the body.

With the foregoing and various other factors in mind, the present invention provides a chair or infant support in which the primary supporting surface or surfaces are provided on or are mounted on a generally upright but forwardly inclined chair body or post configured so that the infant is placed with its abdomen and chest in engagement with a forwardly inclined surface or surfaces. At the lower end of the upright portion of the chair body or post, a rearwardly extending portion, rigidly interconnected with the upright portion, is provided in position to form a seat for the infant positioned on the chair and to aid in retaining the infant in the desired generally upright but forwardly inclined position.

The invention also contemplates a chair arrangement having a plurality of supporting components having upper and lower portions inclined upwardly and rearwardly and providing for support of upper and lower portions of the infant's body in a forwardly inclined position under the action of gravity.

The invention further contemplates provision of special supporting means for the head of an infant positioned on the chair. In one embodiment, the head supporting means comprises elements forming a cradle presented at an angle inclined upwardly and rearwardly from the chair body or post. In this embodiment, the head supporting cradle is mounted on the forwardly inclined chair body or post at an elevation below the region of the junction of the head and neck of an infant occupant of the chair, and the head supporting cradle is upwardly and rearwardly inclined to engage the infant in the region of the junction of the head and neck.

In another embodiment, head supporting means are provided in the form of an upwardly and rearwardly presented pad of substantial width and height providing a cushioned area against which various parts of the infant's head may rest.

Preferably, also, the upward and rearward inclination of the head supporting cradle or pad, and also the vertical position thereof, is adjustable in order to accommodate infants of different sizes.

A second vertically adjustable rearwardly open cradle is provided in a position below the head support or cradle, the second cradle also being upwardly and rearwardly inclined and having elements positioned and extended rearwardly sufficiently to embrace the infant's body in the region of the armpits.

The invention also contemplates provision of mounting means for the uppermost or head supporting pad or cradle, said mounting means being disconnectable to provide for removal of the head supporting pad or cradle, thereby adapting the chair for use with infants of sufficient age or development not requiring head support. The invention also contemplates a form of the chair in which seat, abdomen and armpit supports are provided for the infant, but without provision for head support.

Still further, it is an object of the invention to provide a chair of the kind above referred to in which the entire chair structure is mounted upon an upright axis or pivot in a position over a base so that the feet of the infant may contact the base and be employed by the infant to rotate its body to different positions about the upright pivotal axis.

It is still further object of the invention to provide vertical adjustment means for certain portions of the chair, thereby accommodating the chair to infants of different sizes and ages.

BRIEF DESCRIPTION OF DRAWINGS

How the foregoing objects and advantages are attained will appear more fully from the following description of the accompanying drawings, in which:

FIG. 9 is a perspective view of a fourth embodiment, this view omitting most of the seat and also the base support for the chair, and illustrating another form of supporting means for the infant;

FIG. 10 a fragmentary sectional view taken as indicated by the section line 10—10 on FIG. 9; and FIG. 11 a view taken as indicated by the line 11—11 on FIG. 9.

Detailed Description of Drawings:

FIGS. 1 to 4

Referring first to the embodiment shown in FIGS. 1 to 4 inclusive, the chair may be provided with a base, such as indicated at 6, this base here being shown in the form of a circular platform on which the components are mounted.

The chair supported on this base comprises a chair body or post composed of the parts indicated at 7 and 8. These chair body parts are vertically elongated; and the part 7 has a concavely curved surface 9 against which the abdomen and chest areas of the infant's body may rest. The chair body parts 7 and 8 and the surface 9 referred to are inclined forwardly, i.e., toward the right, as viewed in FIG. 1, so that gravity tends to retain the infant's body in contact with the curved surface of the element 7.

Figure 2:
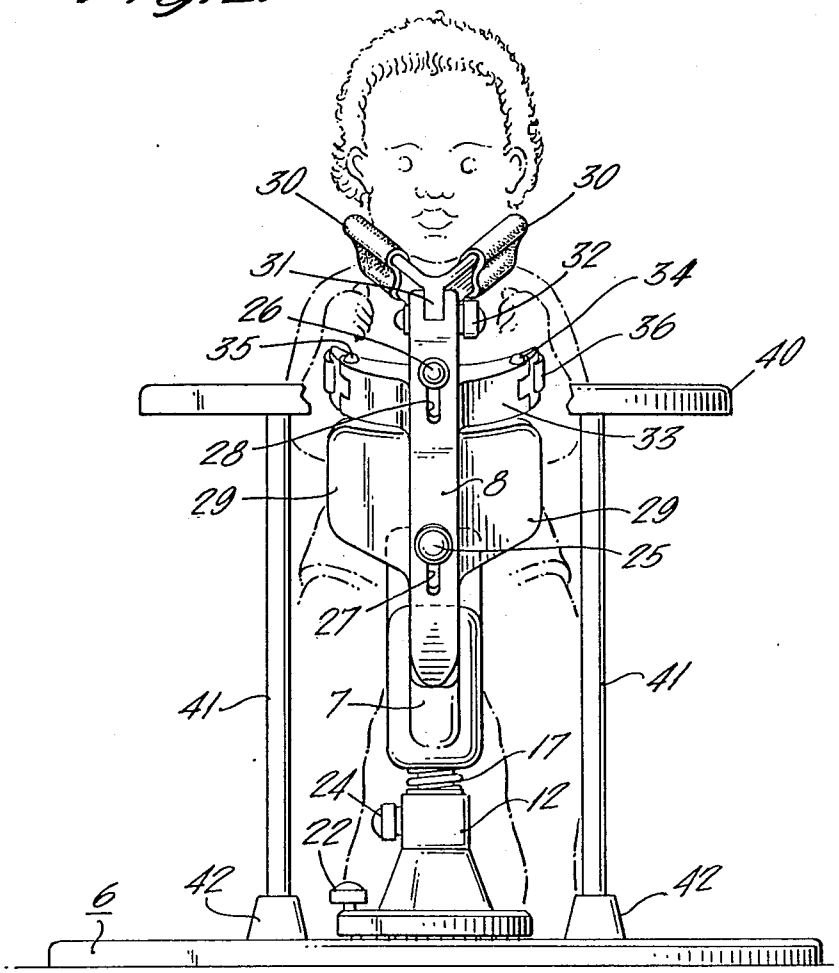
FIG. 2 front view of the chair of FIG. 1, taken from the r hand side of FIG. 1, and also showing the infant in dot-dash lines.
Figure 1:
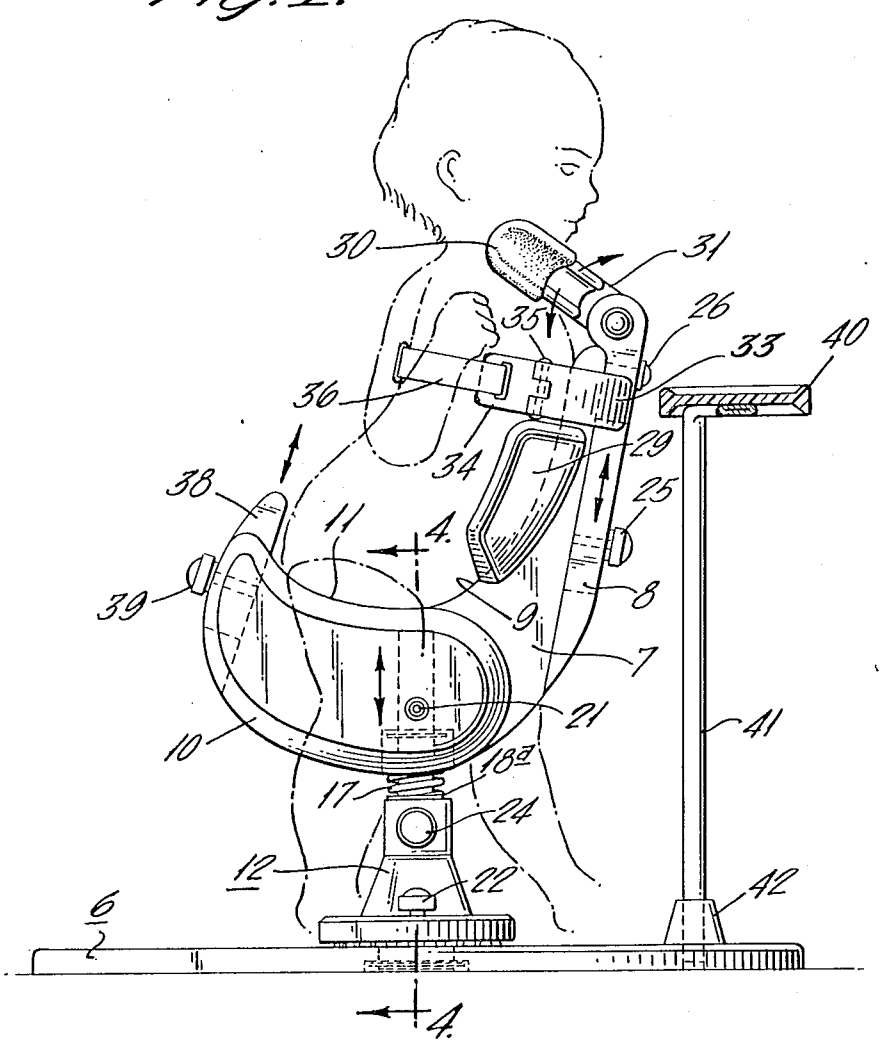
FIG. 1 is a side elevational view of a first embodiment of an infant's chair constructed in accordance with the present invention and showing in dot-dash lines the position of an infant placed in the chair.
Figure 3:
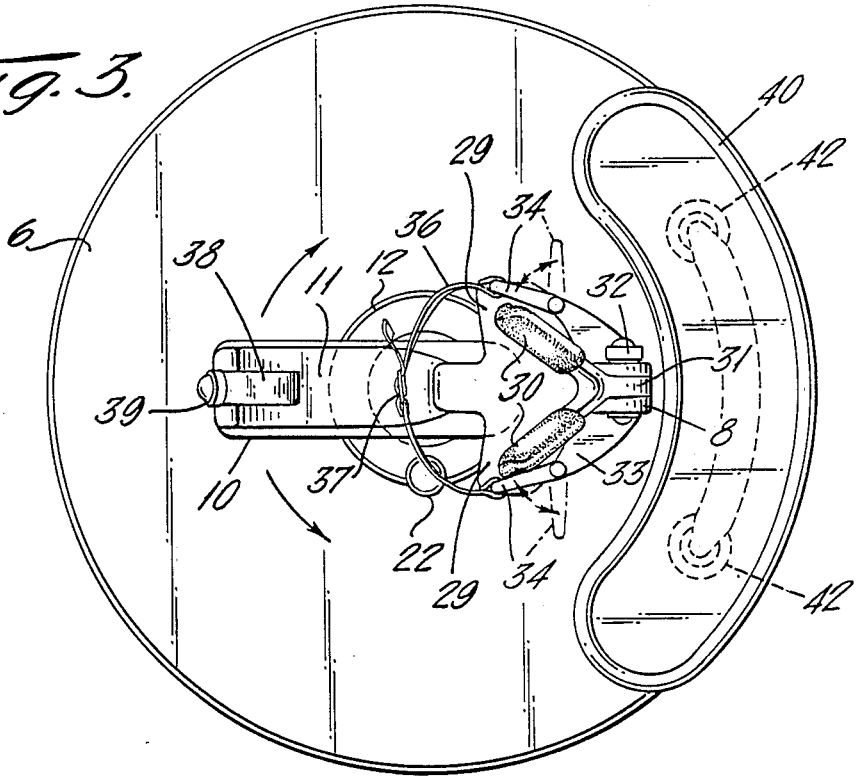
FIG. 3 is a plan view of the arrangement shown in FIGS. 1 and 2 but without an illustration of the infant occupying the chair.

Toward the lower end of the chair body part 7, there is a rearwardly extending portion 10 which is rigidly interconnected with the element 7 and which is positioned to engage the crotch of the infant and to provide a seat for the infant tending to retain the infant in the desired position on the chair under the influence of the action of gravity. As seen in FIG. 1, the upper surface 11 of the rearwardly extended part 10 is curved upwardly to a position behind the rump of the infant. This rearward and upward curvature of the surface 11 aids in providing a contour retaining the infant in the desired seated position on the chair under the action of gravity.

Figure 4:
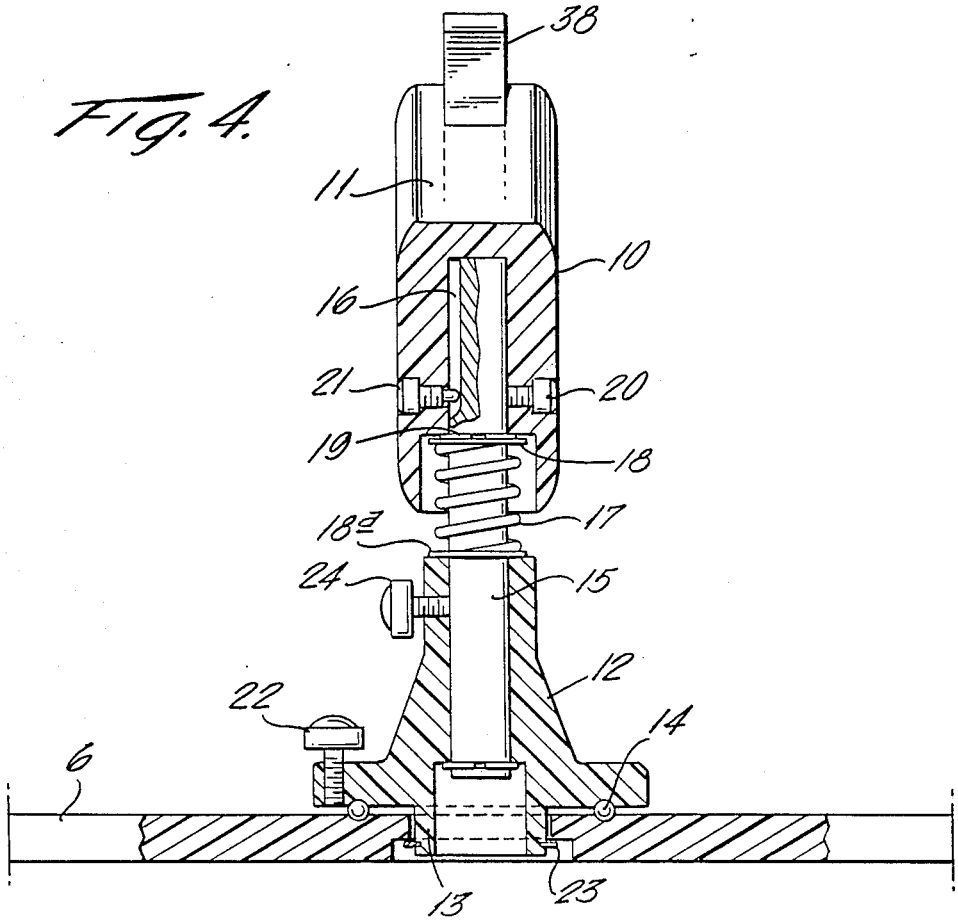
FIG. 4 is an enlarged sectional view of the chair support and certain adjustment devices, taken as indicated by the section line 4—4 on FIG. 1.

The chair body is supported on the base 6 by means of a pedestal 12, which is shown in enlarged vertical section in FIG. 4. This pedestal is mounted upon the base 6, for which purpose, the pedestal has a downwardly projecting cylindrical part 13 engaged in an aperture in the base plate 6. Surrounding the cylindrical part 13, provision is made for introduction of bearings 14 between the pedestal and the base, so that the pedestal and the infant's chair supported thereon may be turned with respect to the base. The center shaft or element 15 is mounted in the pedestal 12 and extends upwardly into an upright cavity 16 formed in the seat portion 10 of the chair body. A spring 17, arranged to react between the seat part 10 and the pedestal, provides for cushioned vertical movement of the chair with respect to the base. For this purpose, a spring abutment washer 18 is provided at the upper end of the spring, the washer reacting against a snap ring 19 positioned in a groove in the center post 15. Another abutment washer **18*a* may be provided between the lower end of the spring and the top of the pedestal 12**.

The set screw 20, which is threaded into the chair seat member 10, provides for fixing the vertical position of the chair body with respect to the central shaft 15. This provides for fixing the vertical position of the chair as a whole with respect to the base. The guide screw 21 projects into a vertical slot formed in the shaft 15 and thereby restrains relative rotation of the chair with respect to the shaft. However, rotation of the chair, and its support as a whole with respect to the base, may occur because of the ball bearings 14 introduced between the lower end of the pedestal and the base. If it is desired to restrain the rotation of the chair as a whole with respect to the base, this may be accomplished by adjustment of the screw 22. If this screw is moved downwardly so that its end comes into engagement with the base, this will restrain the relative rotation. A snap ring 23, associated with the cylindrical part 13, will retain the pedestal and the base in assembled relation.

Another adjustable screw 24 is threaded in the pedestal 12 and is positioned to bear against the center shaft 15; and this screw may be employed when it is desired to lock out the action of the spring 17.

From the above, it will be seen that the mounting and adjustment devices provide for vertical adjustment of the body of the chair with respect to the base, and further provide for alternative use or disabling of the spring, as well as for use or disabling of the rotational freedom of the chair with respect to the base.

The generally upright post elements 7 and 8 of the chair body may be secured to each other by means of the screw devices 25 and 26. These devices are threaded into the element 7 and extend through slotted apertures 27 and 28 provided in the element 8; and this provides for another sense of adjustment described hereinafter. The screw device 25 may comprise a knurled manually operable device serving to clamp or release the element 8 with respect to the element 7; and the screw device 26 may merely be a guide screw fixed in position but providing a clearance for relative motion in the slot 28.

Laterally projecting wing-like parts 29 are secured to the upright element 7 in position to form a cradle engaging the abdomen of an infant occupying the chair. These parts are preferably curved so that they form a cradle upwardly and rearwardly inclined from the element 7, and thereby partially encircle and broaden the area of support for the infant's abdomen. The curvature of the wing parts 29 also follows the contour of the inner surface 9 of the upright support 7 in the vertical direction, thereby providing a broad base of body support for the infant in the chair.

Still further, support for the infant is provided by the chin rest parts 30-30, which are connected with the upper end of the vertically adjustable upright chair body or post element 8. The parts 30-30, in effect, form a rearwardly open cradle, the cradle being upwardly inclined and adapted to engage and support the lower portion of the head of the infant. For the purpose of mounting this cradle, the upper end of the element 8 is forked to receive the central mounting lug 31 of the chin rest structure. A screw 32 penetrates through these mounting parts and provides for adjustment of the upward inclination of these supports and thus also for adjustment with respect to other parts of the chair. The supports 30 are desirably positioned to engage the infant in the region of the junction between the head and neck of the infant. Tightening of the screw 32 provides for retaining the chin supports in the adjusted angular position. The individual chin rest elements 30 are preferably arcuately curved, with the convex side of the curvature presented toward the infant's chin and neck; and these parts are desirably covered with padding in order to cushion the contact with the infant. It is to be noted that these chin rest parts are mounted on the part 8 of the chair body, which is vertically adjustable, in view of which the chin rest parts may readily be moved to the desired height, depending upon the size and age of the infant occupying the chair. The chin or head supports 30-30 serve to restrain excessive forward inclination of the infant's head, and this is of particular importance with very small infants and with infants tending to go to sleep. On the other hand, with older infants, if desired, the head supports 30-30 may even be completely removed as by withdrawal of the fastening screw 32.

The vertically adjustable part 8 of the chair body also carries cradle parts 33 which are inclined upwardly and rearwardly; and to the outer ends of these parts 33, extensions are pivotally connected, as indicated at 34 and 35. Seat belt parts 36 are connected with the extensions and are arranged to be interconnected by the buckle 37 behind the infant's back, thereby assuring retention of the infant on the chair. The parts 33 and 34 serve as a cradle structure which will accommodate infants of different sizes. These parts (33, 34, 35, 36 and 37) are mounted on the vertically movable part 8 of the chair body; and the vertical adjustment of these parts is desirable in order to accommodate infants of different sizes, it being intended that the belt be extended behind the infant from a region under the armpits at the sides of the torso of the infant. Since the upward inclination of the chin supports 30 may be increased or decreased, and since these parts are also carried on the vertically adjustable portion 8 of the chair body, adequate relative adjustment between the chin supports and the cradle 33-34 is provided for accommodating infants of substantially differing sizes and proportions.

Toward the rear end of the seat portion 10, an extension 38 is provided, this extension preferably being fitted into a recess formed in the rear end of the seat part; and a fastening thumb screw 39 is provided so that the extension 38 may be raised or lowered or may be completely removed, if desired.

According to the invention, it is still further contemplated to provide a table structure associated with the chair. In the embodiment illustrated in FIGS. 1 to 4, this table is shown at 40 and is of generally arcuate shape (see particularly FIG. 3). The table is mounted by means of a pair of posts 41 received in sockets 42 provided on the base; and preferably, the posts 41 and sockets 42 are arranged so that if desired, the table may be removed merely by lifting the posts out of the sockets. This arrangement provides a surface on which toys or other articles may be placed in front of the infant occupying the chair.

From the foregoing, it will be seen that the embodiment of the chair illustrated in FIGS. 1 to 4 makes provision for a wide variety of adjustments while, at the same time, assuring positioning of the infant in a secure position in the chair. The forwardly inclined upright portions 7 and 8 and the rigidly interconnected seat portion, with the concave surfaces on these parts presented toward the infant, provide a type of support for the infant concentrating the support on the infant's abdomen and sides, rather than on the infant's back; and this not only assures comfortable infant support but also provides support in a manner particularly suited to the release or burping of unwanted gas from the infant's stomach.

It is still further to be noted that the table is located to be accessible to the hands of an infant in the forwardly inclined position provided by the supporting cradles.

In addition, the vertical and other adjustments provided by the pedestal and the associated parts, provides alternatively for the infant's feet to engage or clear the base either with or without rotational freedom. In the adjusted condition where the infant's feet may engage the base, the infant may turn himself/herself from side to side; and with the presence of the arcuate table in front of the infant, the infant in the forwardly inclined position may play with toys or other articles on the table. These features aid in providing opportunity for self-entertainment of the infant, while maintaining gravitational support for the infant in a comfortable position.

Various of the foregoing features of the support and mounting of the chair, as described in connection with FIGS. 1 to 4, may also be used in other embodiments described hereinafter.

FIG. 5

Figure 5:
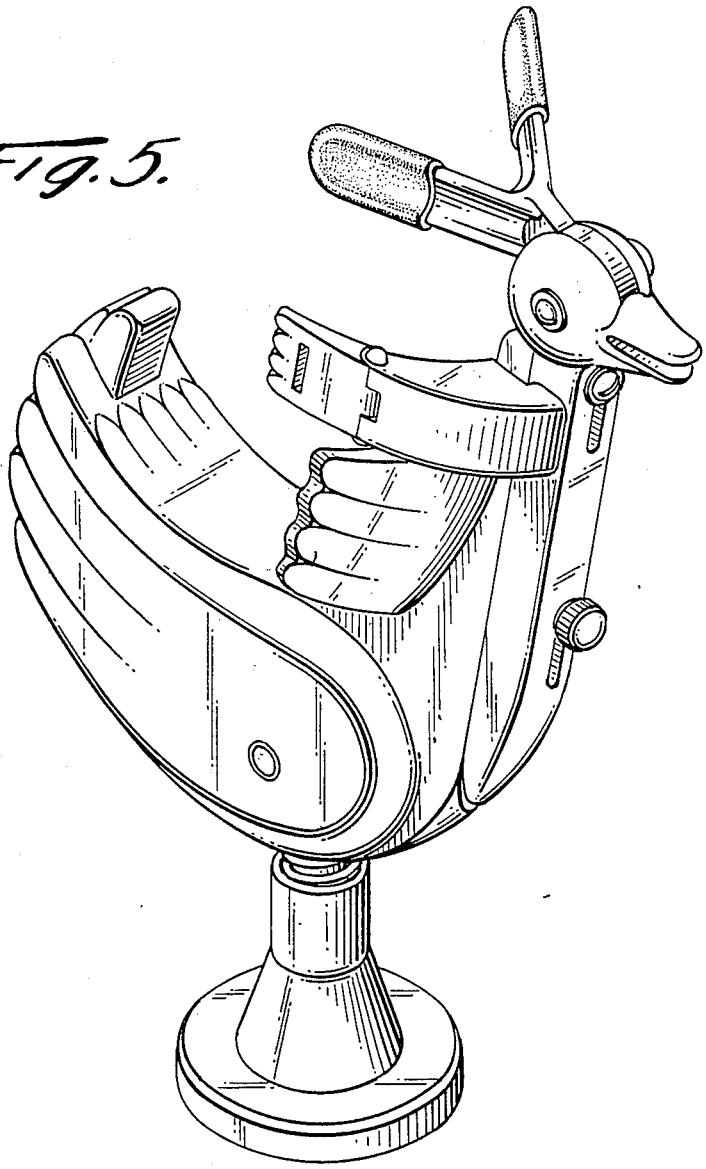
FIG. 5 is a perspective view of a second embodiment of the chair of the present invention, incorporating many of the structural features shown in FIGS. 1 to 4 inclusive as incorporated in a chair having decorative markings and features representing a bird.

In the embodiment illustrated in FIG. 5, all of the structural parts of the chair itself, as above described, may be incorporated in the same functional manner as in the embodiment of FIGS. 1 to 4 inclusive. Figure 5, however, further illustrates the manner in which those structural features may be incorporated in a decorative form representing a bird. Contour lines have been applied to various parts of the body indicating feather components, such as the wings and body of a bird. Positioned at the head end of the upright portion of the body parts, is a replica of the head of a bird.

Figures 6, 7, 8:
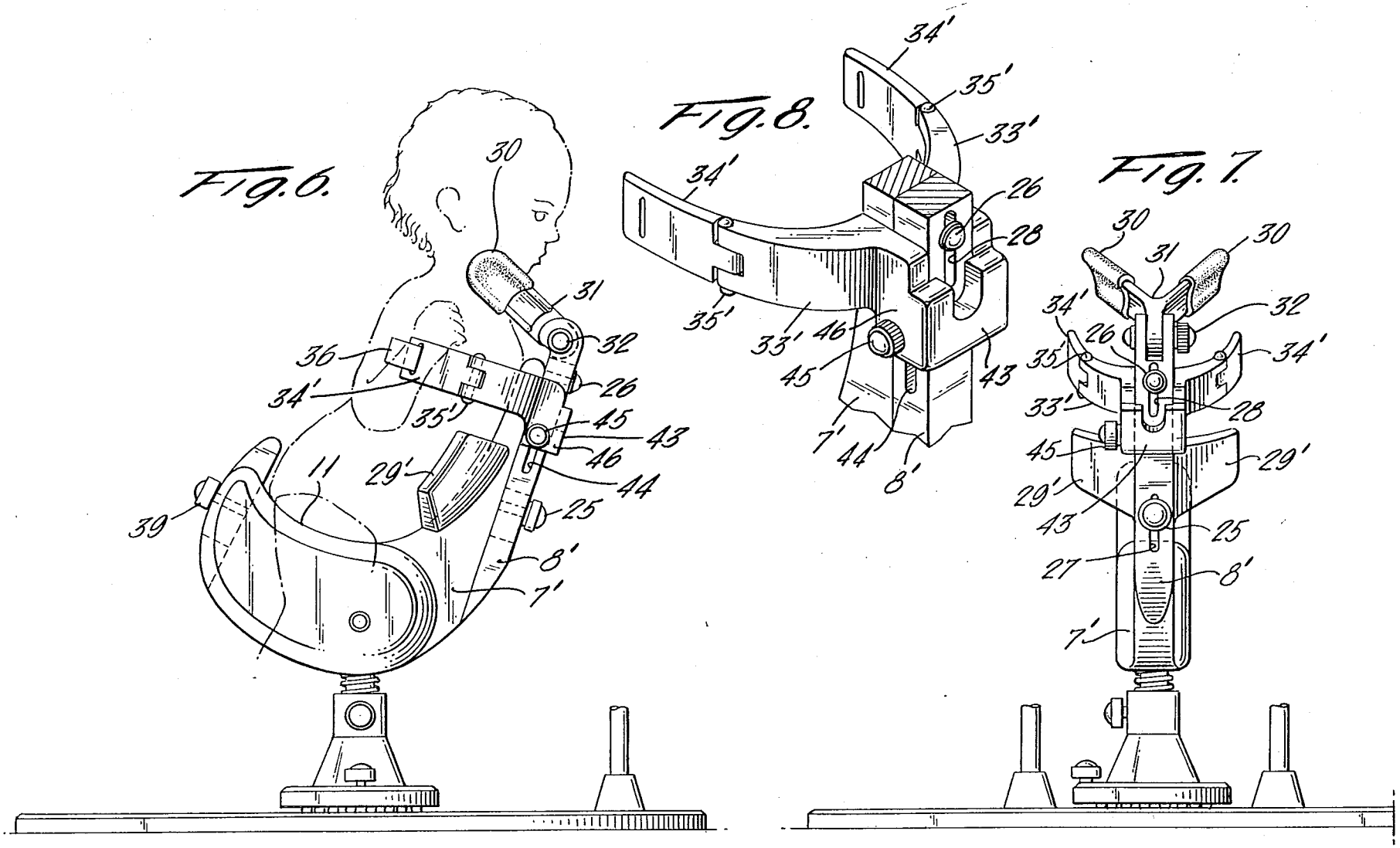
FIG. 6 a view similar to FIG. 1 but illustrating a third embodiment providing an alternative arrangement for effecting relative vertical movement of the cradles for engaging the head and the body of the infant.
FIG. 7 a view similar to FIG. 2 illustrating the third embodiment of FIG. 6.
FIG. 8 is a fragmentary perspective view of certain parts included in the embodiment shown in FIGS. 6 and 7.

FIGS. 6, 7 and 8:

Turning now to the embodiment illustrated in Figures 6, 7 and 8, it is first noted that much of the structure shown is the same as or similar to the structure of FIGS. 1 to 4. However, in the embodiment of FIGS. 6, 7 and 8, some changes have been introduced, particularly with respect to the arrangement of the cradle parts 33'. The two cradle parts 33' at opposite sides of the upright posts 7' and 8' are arranged as separate pieces interconnected only at the front edge by means of the crossweb 43. A slot 44 is formed in the upper portion of the adjustable upright post 8' and a knurled thumb screw 45 extends through the slot 44, the head of this screw abutting against the lug 46 at the lower edge of the adjoining cradle part 33'. The screw 45 is threaded into a lug provided on the other cradle part 33', and the clearances, tolerances and flexibility of these parts is arranged so that manual tightening of the screw 45 will clamp the two cradle parts 33'—33' against the side surfaces of the upright post 8', thereby fixing the vertical position of the cradle 33'—33' with respect to the post 8'. As seen in FIG. 8, the crossweb 43 is provided with a central cut-out slot which will accommodate the screw 26 and thus permit any desired vertical adjustment of the post 8' with respect to the post 7'.

With this arrangement, it will be seen that provision is made for an additional adjustment as compared with the embodiment of FIGS. 1 to 5, i.e., the cradle 33'—33', which is positioned to engage the upper part of the body of the infant, may be vertically adjusted with respect to the head cradle parts 30—30. When in the desired position, the thumb screw 45 may be tightened, thereby flexing the crossweb 43 sufficiently to clamp the opposing surfaces of the lugs 46 against the side surfaces of the post 8', thereby fixing the vertical position of the cradle 33'—33' at the desired elevation. The cradle parts 33'—33' are provided with pivoted extensions 34'—34', and as will be seen from FIGS. 6 and 8, these side components of this cradle extend farther to the rear than in the first embodiment, thereby extending the support for the infant substantially throughout the areas of the armpits.

FIGS. 9, 10 and 11

In the embodiment shown in FIGS. 9, 10 and 11, certain changes have been introduced providing for simplification of the arrangement and the adjustments therefor and also increasing the disposition of the parts from the standpoint of providing for support of the infant in the desired forwardly inclined position under the action of gravity.

Much of the mounting structure for the chair of the embodiment shown in FIGS. 9, 10 and 11, including the pedestal support at the base, may be employed in the manner illustrated in the other embodiments. In addition, if desired, a playing surface or table may also be employed in the manner shown in the first embodiment.

In the embodiment of FIGS. 9 to 11, the generally upright post 7*a* is connected with the seat 10 and extended upwardly and forwardly from the seat as will be apparent from the drawings, and the armpit supports 33*a* and the abdomen supports 29*a* are directly interconnected by means of the structure indicated at 47, this structure having a tongue 48 at the rear edge adapted to be received and to be adjustably moved vertically within a groove provided on the inner side of the upright post 7*a*, as is clearly shown in the sectional view of FIG. 10. The position of the interconnected portions 33*a* and 29*a* may thus be adjusted vertically, and a fastening device, including the knurled knob 49, threaded on the pin or fastening bolt 50, may be employed in order to hold the structures in any adjusted position. The pin or bolt 50 may be provided with threads engaged in the central structure of the abdomen support 29*a*.

In the arrangement of FIGS. 9 to 11, the armpit supports 33*a*—34*a* and the seat belt 36 may be arranged in the general manner above described in connection with earlier embodiments, but the proportioning of the parts 33*a* and 34*a* is contemplated to provide sufficient upward and rearward extension to effectively project at least into, if not through, the armpit regions of the infant occupant.

The arrangement of FIGS. 9 to 11 also incorporates a somewhat different head support arrangement than is illustrated in the preceding embodiments. Preferably, this head support element, as indicated at 51, comprises a pad or cushion, with appropriate interior support mountings on the arm 52, which is connected with the upright support 53 by means of a fastening device indicated at 54 which provides freedom for adjustment of the upward angularity of the pad 51. The upright support 53 is also adjustable in the upward and downward direction by means of the fastening device 55 (see FIG. 11) which is associated with the upper end portion of the upright post 7*a*. It is contemplated that for infants of certain ages, the pad 51 will be configured and serve as a cushion against which the infant may rest it's head either forwardly or toward one side or the other. It is also contemplated that the head support may either be angularly adjusted, by the fastening device 54, or may be vertically adjusted, by the support 53 and its fastening device 55; and it is further contemplated that this head support may be completely removed for use of the chair by infants in the upper age brackets.

In all of these adjusted positions and alternative conditions, it will be noted that the cradles provided by the components 29*a*, 33*a* and 51 are all inclined upwardly and rearwardly so that, in combination with the seat provided at the lower end of the chair, the infant will be retained in the desired forwardly inclined position in the chair under the influence of the action of gravity.

I claim:

1. A chair for infants, comprising a chair body having a generally upright forwardly inclined rigid post, the chair body having an infant support in the form of a seat connected with said upright post and extended rearwardly from a lower part of said post to engage the crotch of an infant occupant of the chair and provide for seating of the infant under the action of gravity, means for positioning the body of an infant seated on said seat, including first and second pairs of vertically spaced supports, each pair being rigidly connected with said generally upright post in front of the infant occupant and the supports of said pairs being positioned to form rearwardly open cradles located to receive vertically spaced portions of the front of an infant occupant, and each cradle being presented at an angle inclined upwardly and rearwardly from said generally upright post of the chair body and thereby provide for gravitational support of vertically spaced portions of an infant occupant in a forwardly inclined position, the first pair of supports being the uppermost one of said cradles, first connecting means for connecting the first of said cradles with said rigid post at an elevation below the level of the junction of the head and neck of an infant occupant and further having mounting means providing freedom for adjustment of its upward inclination through a range including positions in which the uppermost one of the cradles will engage the region of junction of the head and neck of infant occupants of different sizes, second connecting means for connecting the second of said cradles to the said rigid post at a position spaced lower on the post than the first cradle and further means for positioning the body of an infant seated on said seat further including a pair of positioning parts at an elevation intermediate said first and said second pairs of vertically spaced supports, third connecting means for connecting said positioning parts to the rigid post at a level intermediate the first and second connecting means and encircling the upper portion of the body of an infant occupant in position on the seat of the chair and in a forward inclination independently of the action of gravity.

2. A chair for infants, comprising a chair body having a supporting post and having a seat rigidly connected with and extended rearwardly from said post, the seat being extended upwardly at its rear end sufficiently to form a seat retaining an infant in seated position, means for positioning the body of an infant seated on said seat including an upright supporting element mounted on and vertically adjustable with respect to said post, the infant positioning means including first rigid portions connected with said upright supporting element and projecting both laterally and rearwardly to form a rearwardly open first cradle to engage in the armpits of an infant occupant, and the infant positioning means further including second rigid portions connected with said upright supporting element below said first cradle and projecting laterally and rearwardly to form a rearwardly open second cradle positioned to engage the abdomen of an infant occupant, said first rigid portions, and said first and second cradles being vertically adjustable with relation to the supporting element in order to accommodate infants of different sizes, means for vertically adjusting the upright supporting element with relation to said supporting post and the seat and thereby concurrently vertically adjust said cradles with relation to the seat, the chair still further including a head supporting cradle mounted on and presented upwardly and rearwardly from the supporting post, and means providing for adjustment of the upward and rearward inclination of said head supporting cradle, the rearward and upward extension of said seat, the offset of said first and second rigid portions and the lateral and rearward projection of said cradles, providing for support of an infant in the chair in a forwardly inclined position under the action of gravity.

3. A chair for infants, comprising a generally upright forwardly inclined rigid post, a seat rigidly connected with said upright post and extended rearwardly from a lower part of said post to engage the crotch of an infant occupant of the chair, said seat being inclined upwardly both forwardly and rearwardly of the center portion of the seat and thereby maintain seating of the infant in said center portion of the seat under the action of gravity, said crotch engaging seat and said rigid post having occupant engaging surface areas which are rigidly interconnected and are substantially uninterrupted throughout at least most of the seating and abdominal and chest regions of the infant occupant from the region of the center portion of the crotch engaging seat forwardly and thence upwardly along the forwardly inclined post, said uninterrupted areas comprising means for support of an infant occupant under the action of gravity from the region of the center portion of the crotch to the region of the chest of the occupant, means for maintaining the position of the body of an infant occupying the chair including a pair of positioning parts encircling the upper portion of the body of an infant occupant in the region of the chest and armpits, said positioning parts each including pivotally connected elements at each side of the occupant and being connected to the post spaced upwardly from the seat in the region of the post adjacent the chest and armpits, said positioning parts comprising means for retention of an infant occupant in position on the seat of the chair and in a forward inclination in contact with said occupant engaging surface areas of said forwardly inclined post independently of the action of gravity and a head support mounted on the post above the level of the positioning parts encircling the body of the occupant, said head support being located in the region of the junction of the head and neck of the occupant.

4. A chair as defined in claim 3 in which the positioning parts at each side of the occupant include interconnected rigid and flexible elements, and separable means for interconnecting the flexible elements in a region behind the occupant.

5. A chair for body support, comprising a generally upright forwardly inclined rigid post, a seat rigidly connected with said upright post and extended rearwardly from a lower part of said post to engage the crotch of an occupant of the chair, said seat being inclined upwardly both forwardly and rearwardly of the center portion of the seat and thereby maintain seating of the body in said center portion of the seat under the action of gravity, a pair of body supports connected with a portion of said generally upright post and extended laterally and rearwardly from the post to form a cradle spaced vertically above the seat and located to engage the body of the occupant, means connected with said inclined post and providing for relative vertical adjustment of the seat and cradle, said crotch engaging seat and said rigid post having occupant engaging surface areas which are rigidly interconnected and are substantially uninterrupted throughout the seating and abdominal and chest regions of the occupant from the region of the center portion of the crotch engaging seat forwardly and thence upwardly along the forwardly inclined post to the said cradle, said uninterrupted areas comprising means for support of an occupant under the action of gravity from the region of the center portion of the crotch to the region of the armpits of the occupant, means for maintaining the position of the body of an occupant including a pair of positioning parts encircling the upper portion of the body of the occupant, said positioning parts each including pivotally connected elements at each side of the occupant and means connecting each said part with the post, above said cradle, and separable means for interconnecting the pivotally connected elements in a region behind the occupant and comprising means for retention of an occupant in position on the seat of the chair and in a forward inclination in contact with said occupant engaging surface areas of said forwardly inclined post independently of the action of gravity.

* * * * *